US011339777B2

(12) United States Patent
Cheng et al.

(10) Patent No.: US 11,339,777 B2
(45) Date of Patent: May 24, 2022

(54) AUTOMATIC SELF-DRIVING PUMPS

(71) Applicant: FLOW CONTROL LLC, Morton Grove, IL (US)

(72) Inventors: Andrew A. Cheng, Morton Grove, IL (US); Christopher S. Johnson, Gurnee, IL (US); James J. Gu, Buffalo Grove, IL (US); Kyle Schoenheit, Waterloo, NY (US)

(73) Assignee: FLUID HANDLING LLC, Morton Grove, IL (US)

( * ) Notice: Subject to any disclaimer, the term of this patent is extended or adjusted under 35 U.S.C. 154(b) by 92 days.

(21) Appl. No.: 16/826,556

(22) Filed: Mar. 23, 2020

(65) Prior Publication Data

US 2020/0291932 A1 Sep. 17, 2020

Related U.S. Application Data

(63) Continuation of application No. 15/701,784, filed on Sep. 12, 2017, now abandoned.
(Continued)

(51) Int. Cl.
*F04B 49/06* (2006.01)

(52) U.S. Cl.
CPC ..... *F04B 49/065* (2013.01); *F04B 2201/12* (2013.01); *F04B 2203/0202* (2013.01);
(Continued)

(58) Field of Classification Search
None
See application file for complete search history.

(56) References Cited

U.S. PATENT DOCUMENTS 4,209,131 A 6/1980 Barash et al.
4,934,096 A 6/1990 Bentvelsen
(Continued)

FOREIGN PATENT DOCUMENTS

AU 2014250705 A1 11/2014
CA 2950605 A1 12/2015
(Continued)

OTHER PUBLICATIONS

English Abstract of CN 1352733A (and Abstract of corresponding U.S. Pat. No. 6,464,464).
(Continued)

*Primary Examiner* — Mohammad Ali
*Assistant Examiner* — Saad M Kabir
(74) *Attorney, Agent, or Firm* — Ware, Fressola, Maguire & Barber LLP

(57) ABSTRACT

An automatic self-driving pump system features a pump/motor/drive detector and an automatic self-driving and control design/setup module. In operation, the pump/motor/drive detector receives sensed signaling containing information about a pump/drive for operating in a hydronic pump system, e.g., stored in and sensed from a signature chip or barcode installed that can be scanned by a scanner, and provides corresponding database signaling containing information about parameters for providing automatic pump control design, setup and run to control the pump/drive for operating in the hydronic pump system, based upon the sensed signaling received. The automatic self-driving and control design/setup module receives the corresponding database signaling, and provides control signaling containing information for providing the automatic pump control design, setup and run to control the pump/drive for operating in the hydronic pump system, based upon the corresponding database signaling received.

23 Claims, 5 Drawing Sheets

ASD-pumps functional model.

Related U.S. Application Data

(60) Provisional application No. 62/393,312, filed on Sep. 12, 2016.

(52) U.S. Cl.
CPC ..... *F04B 2203/0208* (2013.01); *F05B 2270/1016* (2013.01); *F05B 2270/708* (2013.01)

(56) References Cited

U.S. PATENT DOCUMENTS

| | | | | |
|---|---|---|---|---|
| 5,959,547 | A | 9/1999 | Tubel et al. | |
| 6,510,350 | B1 | 1/2003 | Steen, III et al. | |
| 6,873,267 | B1 | 3/2005 | Tubel et al. | |
| 7,277,778 | B2 | 10/2007 | Burns, Sr. et al. | |
| 8,024,161 | B2 | 9/2011 | Pekar et al. | |
| 8,627,597 | B2 | 1/2014 | Solano Cabello | |
| 9,013,322 | B2 | 4/2015 | Roberson et al. | |
| 9,262,361 | B2 | 2/2016 | Cedrone et al. | |
| 2001/0041139 | A1* | 11/2001 | Sabini | F04D 15/0066 417/18 |
| 2007/0175633 | A1 | 8/2007 | Kosmala et al. | |
| 2012/0230846 | A1 | 9/2012 | Stephens | |
| 2013/0105010 | A1 | 5/2013 | McLoughlin | |
| 2014/0005841 | A1* | 1/2014 | Cheng | G05D 7/0617 700/282 |
| 2014/0091153 | A1 | 4/2014 | Stefanski et al. | |
| 2014/0200690 | A1 | 7/2014 | Kumar | |
| 2014/0249682 | A1 | 9/2014 | Cheng et al. | |
| 2015/0027548 | A1 | 1/2015 | Moriarty | |
| 2015/0032271 | A1 | 1/2015 | Cheng | |
| 2015/0308244 | A1 | 10/2015 | Cardamone et al. | |
| 2015/0313484 | A1* | 11/2015 | Burg | A61B 5/021 600/301 |
| 2015/0379856 | A1 | 12/2015 | Glenn et al. | |
| 2016/0010639 | A1 | 1/2016 | Cheng | |
| 2016/0017889 | A1 | 1/2016 | Cheng | |
| 2016/0102537 | A1* | 4/2016 | Lopez | E21B 43/26 700/282 |
| 2016/0142891 | A1 | 5/2016 | Virhia | |
| 2016/0212954 | A1 | 7/2016 | Argento | |

FOREIGN PATENT DOCUMENTS

| | | | |
|---|---|---|---|
| CN | 1352733 | A | 6/2002 |
| CN | 203730347 | U | 7/2014 |
| RU | 2600202 | C2 | 10/2016 |
| WO | 0057063 | A1 | 9/2000 |
| WO | 2016106227 | A1 | 6/2016 |

OTHER PUBLICATIONS

English language abstract of CN203730347.

Kim, Y., et al, "Remote Sensing and Control of an Irrigation System Using a Distributed Wireless Sensor Network," IEEE Transactions on Instrumentation and Measurement, Jul. 2008, 57(1), pp. 1379-1387. http://pubag.nal.usda.gov/pubag/downloadPDF.xhtml?id=53900&content=PDF.

Marhaenanto, B., et al., "Development of an internet-based greenhouse control system," International Agricultural Engineering Journal, Jun. 2013),22(2), pp. 72-83. https://www.researchgate.net/profile/Peeyush_Soni/publication/259010991_Development_of_an_internet-based_greenhouse_control_system/links/02e7e537ee12ea607d000000.pdf.

English Abstract of RU 2600202 C2.

* cited by examiner

*FIG. 1*: Variable speed pump controls with advanced energy saving and sensorless control technologies.

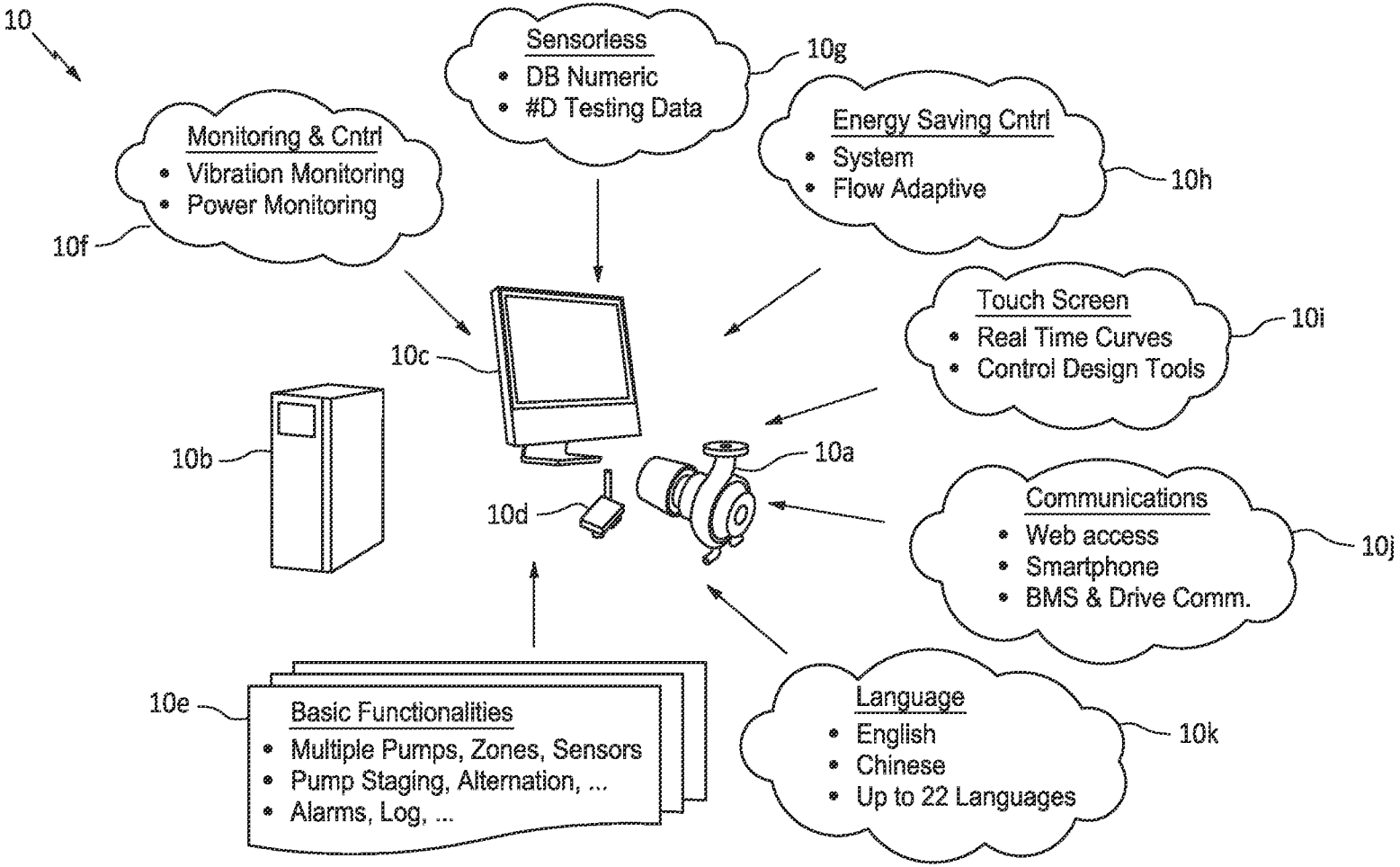
*FIG. 2A* : Remote control configuration
*FIG. 2* : ASD-pumps integrated with a pumping control of a) remotely in a computer or b) locally attached.

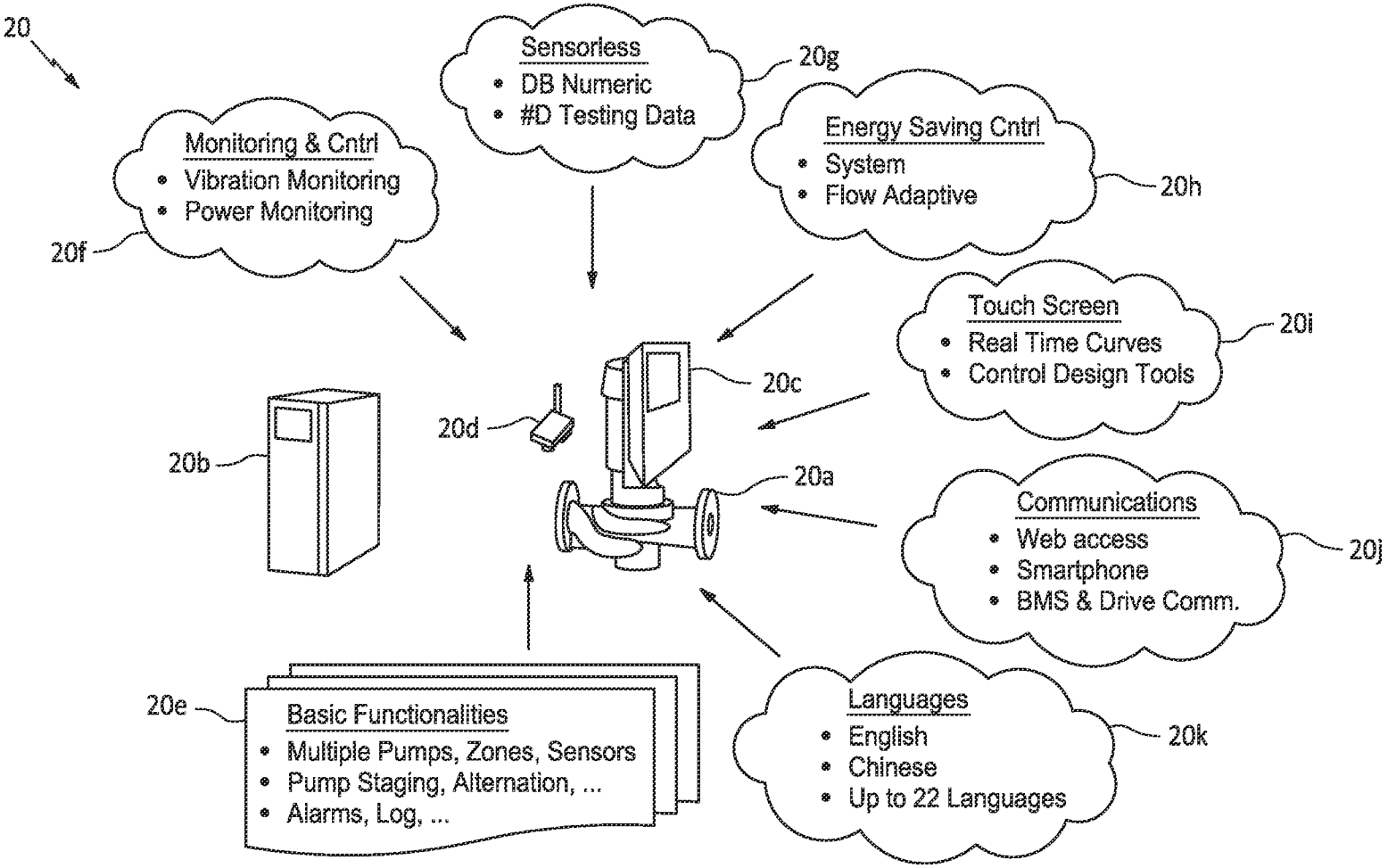
*FIG. 2B* : Locally attached control configuration
*FIG. 2* : ASD-pumps integrated with a pumping control of a) remotely in a computer or b) locally attached.

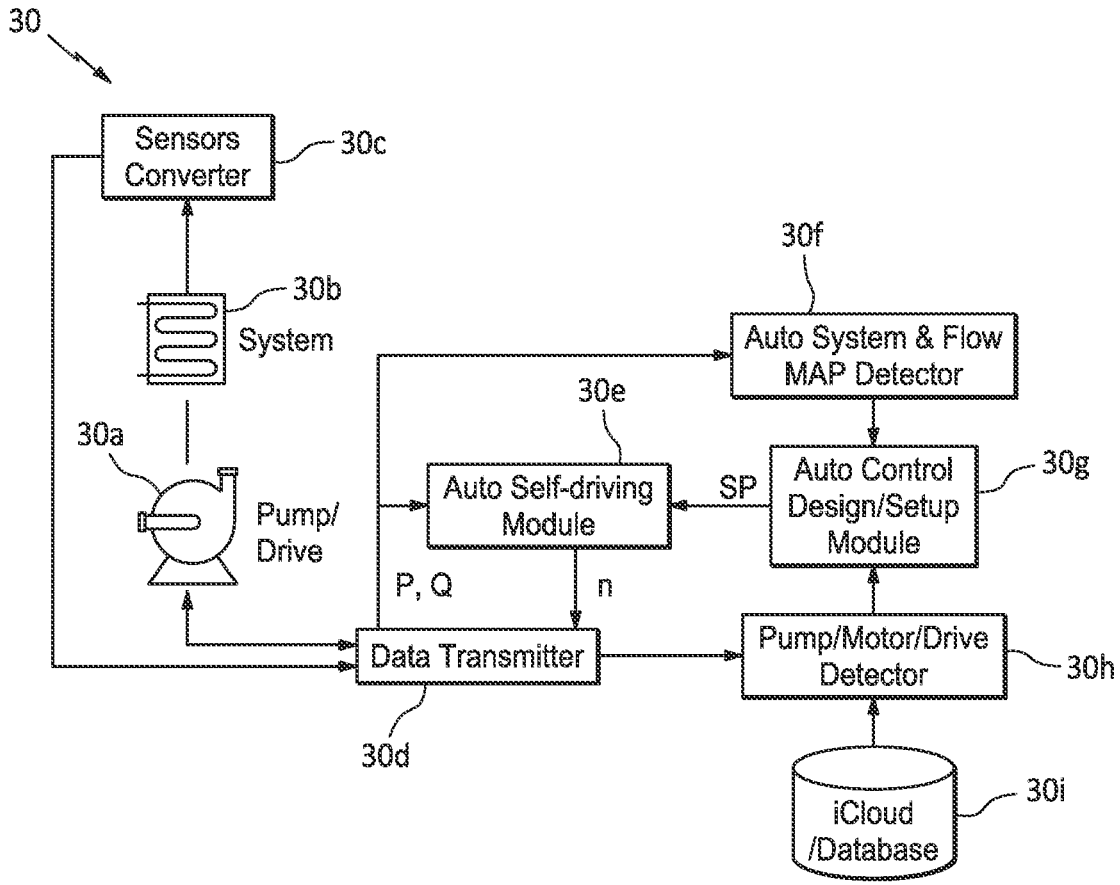
*FIG. 3* : ASD-pumps functional model.
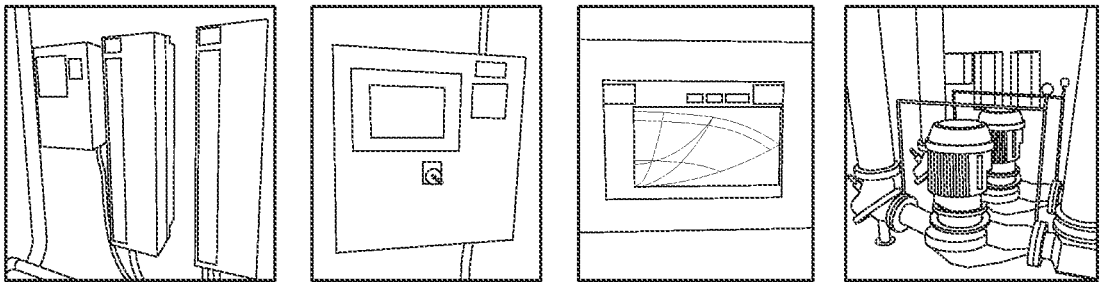
*FIG. 4* : An ASD-pumps prototype with a touch screen pumping control system.

A control or controller 40 for a module or device 10b, 20b 30c, 30d, 30e, 30f, 30g, 30h or 30i in Figures 2 and 3 that forms part of an automatic self-driving pump system A signal processor or processing module 40a configured at least to:

receive signaling containing information for performing or implementing signal processing functionality associated with at least one of the modules or devices 10b, 20b, 30c, 30d, 30e, 30f, 30g, 30h or 30i in Figure 2 and 3;

determine corresponding signaling containing information for providing from the modules or devices 10b, 20b, 30c, 30d, 30e, 30f, 30g, 30h or 30i in Figures 2 and 3 in order to implement the signal processing functionality, based upon the signaling received; and/or provide the corresponding signaling as control and/or design signaling from the modules or devices 10b, 20b, 30c, 30d, 30e, 30f, 30g, 30h or 30i in Figures 2 and 3 to implement the signal processing functionality in the automatic self-driving pump system.

Other signal processor circuits or components 40b that do not form part of the underlying invention, e.g., including input/output modules, one or more memory modules, data, address and control busing architecture, etc.

*FIG. 5*

AUTOMATIC SELF-DRIVING PUMPS

CROSS REFERENCE TO RELATED APPLICATION

This application is a continuation of, and claims benefit to, patent application Ser. No. 15/701,784, filed 12 Sep. 2017, which claims benefit to U.S. provisional application No. 62/393,312, filed 12 Sep. 2016, which are both hereby incorporated by reference in its entirety.

BACKGROUND OF THE INVENTION

1. Field of the Invention

The present invention relates to a technique for controlling a pump; and more particularly relates to a technique for controlling a pump in a system of pumps.

2. Brief Description of Related Art

Recently, variable speed pump controls with advanced real time graphic pumping operation display, energy saving and sensorless control technologies [see reference nos. 1-11 summarized and incorporated by reference below] set forth for heating and cooling close loop hydronic applications, pressure booster, industrial and agriculture applications, e.g., as shown in FIG. 1. With those new techniques introduced, some pump system operation parameters or characteristics curves traditionally unknown, such as vary system characteristics curves, adaptive control set point, pressure or flow rate (without sensors), and so forth, may become known and presentable to engineers and operators for understanding better the pump/system/control operation status in real time and make the pumping control set up and run easier.

Certain procedures and experiences are still needed, however, to setup and to run a pump upon an unknown hydronic system properly. It is still a tedious task even with a quick start screen to set up and run a hydronic pumping system.

Therefore, there is a need in the industry for an automatic self-driving pumping system, including setup and run automatically on an unknown hydronic system and a drive, e.g., similar to the concept as in an automatic self-driving car in car making industries.

SUMMARY OF THE INVENTION

In summary, the present invention provides an automatic self-driving pump (ASD-pump) technique for automatic pump control design, setup and run. ASD-pump control may consists of control modules with automatic pumps/motor/drives parameter detection and configuration, automatic system and flow detection and recognition, automatic pump control design, setup and self-driving, and a data transmitter for sensors and drives signals through a communication protocol. Hence, an ASD-pump is a pump integrated with a remote or locally attached pumping control which has automatic pump control design, setup and self-driving capabilities with any unknown hydronic system. With an ASD-pump, the pumping control design, setup and operation will be significantly changed and will be a new featured model in pump manufacturing industries.

Moreover, the present invention builds on this family of technologies disclosed in the aforementioned related applications identified herein.

SPECIFIC EMBODIMENTS

According to some embodiments, the present invention may include, or take the form of, an automatic self-driving pump system, comprising:

a pump/motor/drive detector configured to receive sensed signaling containing information about a pump/drive for operating in a hydronic pump system, e.g., stored in and sensed from a signature chip or barcode installed that can be scanned by a scanner, and provide corresponding database signaling containing information about parameters for providing automatic pump control design, setup and run to control the pump/drive for operating in the hydronic pump system, based upon the sensed signaling received; and an automatic self-driving and control design/setup module configured to receive the corresponding database signaling, and provide control signaling containing information for providing the automatic pump control design, setup and run to control the pump/drive for operating in the hydronic pump system, based upon the corresponding database signaling received.

According to some embodiments, the present invention may include one or more of the following features:

The pump/motor/drive detector may be configured to receive the sensed signaling, and provide corresponding signaling requesting parameters for providing the automatic pump control design, setup and run to control the pump/drive; and receive database signaling containing information about the parameters for providing the automatic pump control design, setup and run to control the pump/drive, and provide the corresponding database signaling.

The pump/motor/drive detector may be configured to receive the sensed signaling from a data transmitter, including where the automatic self-driving pump system includes the data transmitter.

The automatic self-driving and control design/setup module may include:

an automatic control design/setup module configured to receive the corresponding database signaling, and provide automatic control design/setup signaling containing information for providing an automatic control design/setup; and an automatic self-driving module configured to receive the automatic control design/setup signaling, and provide the control signaling containing information for providing the automatic pump control design, setup and run to control the pump/drive.

The automatic self-driving pump system may include a pump/motor/drive database configured to receive the sensed signaling and provide the corresponding database signaling.

The pump/motor/drive database may include an ICLOUD® or ICLOUD®-based database.

According to some embodiments, the present invention may also take the form of a method including steps for:

receiving in a pump/motor/drive detector sensed signaling containing information about a pump/drive for operating in a hydronic pump system, e.g., stored in and sensed from a signature chip or barcode installed that can be scanned by a scanner, and providing corresponding database signaling containing information about parameters for providing automatic pump control design, setup and run to control the pump/drive for operating in the hydronic pump system, based upon the sensed signaling received; and receiving in an automatic self-driving and control design/setup module the corresponding database signaling, and providing control signaling containing information for providing the automatic pump control design, setup and run to control the pump/drive for operating in the hydronic pump system, based upon the corresponding database signaling received. The method may also include one or more of the features set forth herein, e.g., consistent with that set forth herein.

In effect, the present invention provides a solution to the need in the industry for an automatic self-driving pumping system, including setup and run automatically on an unknown hydronic system and a drive, e.g., similar to the concept as in an automatic self-driving car in car making industries.

Moreover, the present invention provides a new technique that is a further development of, and builds upon, the aforementioned family of technologies set forth below.

BRIEF DESCRIPTION OF THE DRAWING

The drawing includes the following FIGS. 1-5, which are not necessarily drawn to scale:

FIG. 2 includes FIGS. 2A and 2B, showing ASD-pumps integrated with a pumping control configured remotely in FIG. 2A and locally attached in FIG. 2B, according to some embodiments of the present invention.

FIG. 3 shows ASD-pumps functional model, according to some embodiments of the present invention.

FIG. 4 shows photos of an ASD-pump prototype with a touch screen pumping control system, according to some embodiments of the present invention.

FIG. 5 is a block diagram of a controller having a signal processor or processing module configured therein for implementing signal processing functionality for one or more modules, according to some embodiments of the present invention.

Figure 1A:
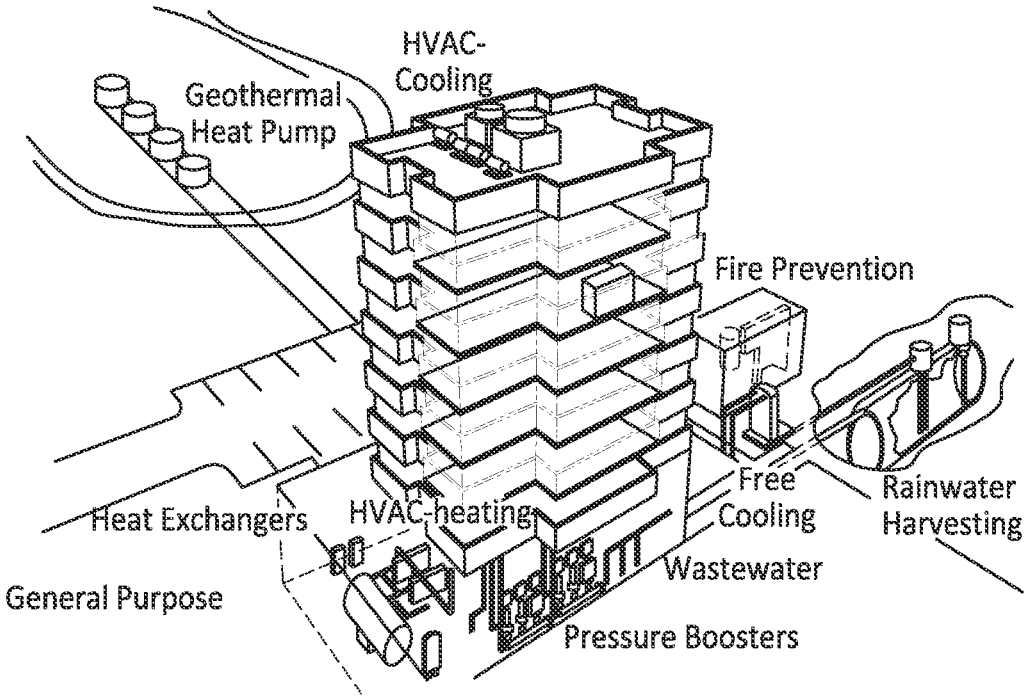
FIG. 1 includes FIGS. 1A and 1B, showing in FIG. 1A a diagram of a building, structure or facility having one or more of HVAC heating and cooling, heat exchangers, pressure boosters, rainwater harvesting, geothermal heat pumps, fire protection, wastewater, etc., e.g., that may also include pumps having variable speed controls with advanced energy savings and sensorless control technology for controlling pumping processes shown in FIG. 1B.
Figure 1B:
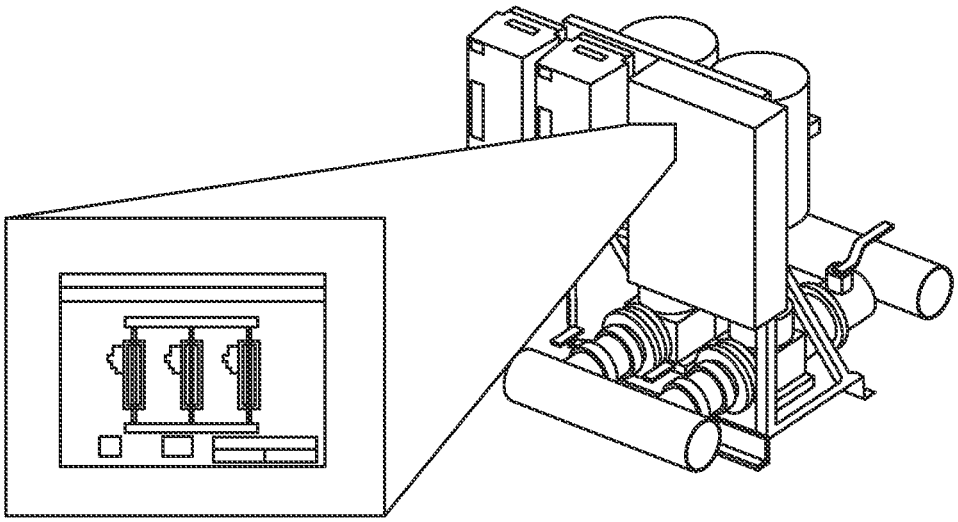

It is noted that arrows included in drawing are provided by way of example, and are not intended to be strictly construed and limiting. For example, a two-way arrow may be interpreted to represent a primary function having two-way communications, while a one-way arrow may be interpreted to represent a primary function having one-way communications. However, as one skilled in the art would appreciate, any one-way arrow does not, and is not intended to, preclude a signaling communication exchange in the other direction, e.g., that may form part of the primary function, or as part of a secondary function like a handshaking operation between any two such modules or devices.

DETAILED DESCRIPTION OF THE INVENTION

1. Introduction

In summary, the present invention provides an automatic self-driving pump (ASD-pump) technique for automatic pump control design, setup and run. By way of example, the ASD-pump control may include control modules with automatic pumps/motor/drives parameter detection and configuration, automatic system and flow detection and recognition, automatic pump control design, setup and self-driving, and a data transmitter for sensors and drives signals through a communication protocol. Hence, an ASD-pump may include a pump integrated with a remote or locally attached pumping control which has automatic pump control design, setup and self-driving capabilities with any unknown hydronic system. With an ASD-pump, the pumping control design, setup and operation will be significantly changed and will be a new featured model in pump manufacturing industries.

2. Automatic Self-Driving Pumps

ASD-Pumps Configuration

The ASD-pumps configuration may include the following:

An automatic self-driving pump (hereinafter "ASD-pump") is an integrated pumping control system generally indicated as 10, which is designed, setup and run automatically on an unknown hydronic systems with energy saving, sensorless as well as some other advanced features as shown in FIG. 2. The ASD-pump consists of a pump 10*a* integrated with a pumping control for (a) remotely (FIG. 2A) using a computer 10*b*, 10*c* or (b) a locally (FIG. 2B) attached control configuration using a touch screen monitor 20*c*, a data transmitter 10*d*, 20*d* for converting sensors signals to a pumping control through a communication protocol, and a VFD drive, respectively.

By way of example, the basic control functionality 10*e*, 20*e* provide may include controlling and coordinating multiple pumps, zones and sensors, pump staging, alarms, log, etc.; the monitoring and control functionality 10*f*, 20*f* may include vibration and power monitoring; the sensorless functionality 10*g*, 20*g* may include DB numeric and 3D testing data; the functionality for energy saving control 10*h*, 20*h* may include system and adaptive control; the functionality for touch screen 10*i*, 20*i* may include real time curves and control design tools; the functionality for communication 10*j*, 20*j* may include web access, smartphone BMS and drive communications; and the functionality for language 10*h*, 20*h* may include British, Chinese and numerous other languages, e.g., consistent with the functionality shown in FIGS. 2A and 2B.

FIG. 3 shows an ASD-pump concept and functional model generally indicated 30, e.g., which may consist of a pump/drive 30*a*, a system 30*b*, a Sensors converter 30*c*, a Data Transmitter 30*d*, an Automatic Self-driving Module 30*e*, an Automatic System and Flow MAP Detector 30*f*, an Automatic Control Design/Setup Module 30*g*, an Automatic Pump/Motor/Drive Detector 30*h*, and a pump/motor/drives database or ICLOUD® 30*i*.

Here, the Automatic Pump/Motor/Drive Detector 30*h* may be used for pumps, motors and drives selection and configuration automatically, based upon their signature chip or barcode installed which can be scanned into the pump control system automatically by a scanner once installed. By way of example, their parameters (e.g., including power, voltage, phase, RPM, impeller size, pump curves data, and so on) can be searched and configured automatically from the pump/motor/drive database or ICLOUD® 30*i* by the Automatic Pump/Motor/Drive Detector 30*h*, based upon their signatures. By way of example, and consistent with that shown in FIG. 3, in operation the Automatic Pump/Motor/Drive Detector 30*h* receives associated signaling containing information for performing or implementing its Automatic Pump/Motor/Drive Detector signal processing functionality associated with the module 30*h*, determines corresponding signaling SP containing information for providing from the module 30*h* in order to implement the Automatic Pump/Motor/Drive Detector signal processing functionality, based upon the signaling received; and provides the corresponding signaling SP from the module 30*g* to the auto self-driving module 30*e*, as shown, in the automatic self-driving pump system.

The Auto System & Flow MAP Detector 30*f* may be used for obtaining moving average peak (MAP) of an unknown system as well as the flow rate in the system 30*b*. The Auto System & Flow MAP Detector 30*f* may be applicable not only for a static hydronic system, but also for a variable system as well. For instance, a MAP for Automatic System & Flow MAP Detector 30*f* may be defined as following $$\overline{C}_{smax}(t) = \begin{cases} MAP(C_v(t)), & C_v < \overline{C}_{vmax} \\ C_v(t), & C_v \geq \overline{C}_{vmax} \end{cases} \tag{1.1}$$

$$\overline{Q}_{max}(t) = \begin{cases} MAP(Q(t)), & Q < \overline{Q}_{max} \\ Q(t), & Q \geq \overline{Q}_{max} \end{cases}, \tag{1.2}$$

where the MAP is the moving average peak detector, $C_v$ is a system dynamic friction coefficient which can be derived by system flow equation of $C_v = Q/\sqrt{\Delta P}$, where $\Delta P$ is differential pressure of pump, $\overline{C}_{vmax}$ represents the MAP of $C_v$.

Since it is a moving average peak detector up on the system coefficient and flow rate, the $\overline{C}_{vmax}$ and $\overline{Q}_{max}$ obtained through MAP from Eq. (1) are adaptive to system and flow rate changes depending upon the sampling time and filter length in moving average digital filters. All those parameters are derived or set up automatically after the ASD-pump is started initially.

The Auto Control Design/Setup Module 30*g* may be used to configure the adaptive control curve and real time graphic pump characteristics curves and operation parameters accordingly and automatically. The adaptive control equation for deriving an adaptive pressure set point of SP(t) may be defined as following:

$$SP(t) = \left(\frac{Q(t)}{\overline{Q}_{max}(t)}\right)^{\alpha} \left((\overline{Q}_{max}(t)/\overline{C}_{vmax}(t))^2 - b_0\right) + b_0, \tag{2}$$

where $b_0$ is the minimum pressure at no flow, $\alpha$ is a control curve setting parameter varying as $1 \leq \alpha \leq 2$ defined in between a linear curve and a quadratic one. All the parameters in Eq. 2 are set up automatically after the ASD-pump is started initially.

By way of example, and consistent with that shown in FIG. 3, in operation the Auto System & Flow MAP Detector 30*f* receives data transmitter signaling P, Q from the data transmitter 30*d*, e.g., containing information for performing or implementing its Auto System & Flow MAP Detector signal processing functionality associated with the module 30*f*, determines corresponding signaling containing information for providing from the module 30*f* in order to implement the Auto System & Flow MAP Detector signal processing functionality, based upon the signaling received; and provides the corresponding signaling to the auto control design/setup module 30*g*, as shown, in the automatic self-driving pump system.

The Auto Self-driving Module 30*e* may then be used to derive the desired pump speed of n, which is obtained by a PID pump control function with respect to the adaptive pressure set point of SP and the instant pressure value from a pressure transducer or a sensorless converter.

The data transmitter 30*d* attached to the ASD-pump is used mainly for transmitting the sensors and drive signals for a pumping control remotely in the computer through a communication protocol or locally attached on the ASD-pump. Here, the sensors signals transmitted by the data transmitter 30*d* may include control signals, such as flow, pressure, temperature, and so on, and condition monitoring signals, such as vibration, power, or thermal as well. The drive signals may include all those digital and analog input/output (IO) signals for providing drive/pump control.

All those signals mentioned above can be transmitted to the pump control directly without routing through the data transmitter 30*d*, if the drive may provide sufficient analog input terminals.

By way of example, and consistent with that shown in FIG. 3, in operation the data transmitter 30*d* receives associated signaling containing information for performing or implementing its data transmitter signal processing functionality associated with the module 30*d*, determines corresponding signaling (e.g., including signaling P, Q) containing information for providing from the module 30*d* in order to implement the data transmitter signal processing functionality, based upon the signaling received; and provides the corresponding signaling (e.g., including signaling P, Q) from the module 30*d* to the auto self-driving module 30*e*, the pump/motor/drive detector 30*h*, and the pump/drive 30*a*, as shown, in the automatic self-driving pump system. By way of further example, the associated signaling received may include sensor converter signaling from the sensor converters 30*c*, auto self-driving module signaling n from the auto self-driving module 30*e*, and pump/drive signaling from the pump/drive 30*a*, as shown. By way of still further example, the corresponding signaling provided may include data transmitter signaling P, Q containing information about the pressure and flow, e.g., provided to the auto self-driving module 30*e*, as shown, as well as data transmitter signaling provided to the pump/drive 30*a* and the pump/motor/drive detector 30*h*, as also shown.

The Sensors converter 30*c* may be used to convert sensorless signals of system pressure and flow rate. For the sensorless control, the power or one of its equivalent signal such as current or torque may be converted as well. By way of example, and consistent with that shown in FIG. 3, in operation the sensors converter 30*c* receives associated signaling containing information for performing or implementing its sensors converter signal processing functionality associated with the module 30*c* (e.g., including system signaling from the system 30*b*), determines corresponding signaling containing information for providing from the module 30*c* in order to implement the sensors converter signal processing functionality, based upon the systems signaling received; and provides the corresponding signaling from the module 30*c* to the data transmitter 30*d*, as shown, in the automatic self-driving pump system.

By way of example, the Pump/motor/drives database or ICLOUD® 30*i* may contain data for all the pumps, motors and drives, including power, voltage, phase, RPM, impeller size, pump curves, and so on, which can be searched through and configured automatically by the Pump/Motor/Drive Detector 30*h*.

An ASD-pump is an integrated pump and pumping control system, which can be set up and run automatically on an unknown hydronic systems while pump/motor/drive are configurable automatically from the database or ICLOUD® 30*i*. In the present invention, the model in FIG. 3, including the Auto Self-driving Module 30*e*, Auto System & Flow MAP Detector 30*f*, and Auto Control Design/Setup Module 30*g*, are the core components for an ASD-pump to run in terms of automatic and self-driving key features, while the Pump/Motor/Drive Detector 30*h*, the Data transmitter 30*d* and Sensors converter 30*c* are fundamental function modules to make those features realized and feasible as well.

ASD-Pump Setup and Run Procedures

The ASD-pump setup and run procedures may include the following:

After an ASD-pump is installed and powered up, the pump control will collect pump, motor and drive data first by the Pump/Motor/Drive Detector 30*h*, based upon the signature chip or barcode installed and scanned into the pumping control from the database or ICLOUD® 30*i* automatically.

The ASD-pump may then starting to run according to its initial setup control curve based upon the pump data from the Pump/Motor/Drive Detector 30*h* and instant input signals of flow and pressure through sensors or sensorless converter. The designed duty point of $\overline{C}_{vmax}$ and $\overline{Q}_{max}$ are derived continuously and accordingly by the Auto System & Flow MAP Detector 30*f*.

The control curve equation may then be defined accordingly based upon the designed duty point of $\overline{C}_{vmax}$ and $\overline{Q}_{max}$ by the Automatic Control Design/Setup Module 30*g*. The other parameters in control equation, such as the minimum pressure at no flow, $b_0$, the control curve setting parameter, $\alpha$, may be predefined as a default for automatic self-driving.

The pump may then be running under an Auto Self-driving Module control, with the desired pump speed of n which is obtained by a PID pump control function with respect to the adaptive pressure set point of SP and the instant pressure value from a pressure transducer or a sensorless converter.

The ASD-pump is then running automatically and adaptively with respect to system and flow rate changes, since its control equation defined by the design point varies with respect to moving average maximum of system and flow rate in system, with best pumping efficiency and sensorless as well, if selected.

ASD-Pumps Basic Features

The ASD-pumps Basic Features are as follows:

- The ASD-pump is a pump integrated with a pumping control of (a) remotely (FIG. 2A) in a computer or (b) locally attached (FIG. 2B), and the data transmitter 30*d* to transfer the signals and control data from sensors and VFD drives to the pump control through a communication protocol.
  - Hooked up with pre-selected pumps/motors/drives with its signature chip automatically based upon the database or ICLOUD® 30*i*.
- Hooked up with any unknown hydronic systems, automatically and independently.
- Design, setup and run pumping control automatically.
- Automatic self-driving with flow & system adaptive control on any unknown hydronic systems with energy saving features.
- Sensorless for pumping flow rate and pressure signals for control and monitoring.
- Pump control design toolbox for onsite pumping and control design and setup, if needed.
- Real time graphic display control, pump and system characteristics curves and pumps operation values and status.
- Multiple pumps control capabilities.
- ICLOUD® data storage, monitoring and presentation.

ASD-Pumps Prototype

FIG. 4 shows an ASD-pumps Prototype, as follows:

In FIG. 4, the ASD-pump prototype integrated with locally attached pumping control has automatic pump control design, setup and self-driving capabilities with any unknown hydronic system. Note that the pumping control panel was detached during testing in the pictures shown below.

By utilizing the pump control design toolbox integrated in the touch screen pump controller (e.g., see 20*c*) of the ASD-pump, the pump control curve is designed, set up and run automatically to meet the system flow and pressure requirement for an unknown hydronics system. The ASD-pump control curve may be designed and setup automatically with respect to the pump, drive and system characteristics curves, in real time on site and flexible for any unknown hydronic system, to achieve the best pumping operation efficiency to save energy. In addition, all the information regarding the pump, system, control operation and their read outs may be displayed graphically and numerically, that makes the pump operation and maintenance much easier as well.

By way of example, and consistent with that set forth herein, the ASD-pump prototype in FIG. 4 essentially consists of the Sensors converter 30*c*, the Data Transmitter 30*d*, the Automatic Self-driving Module 30*e*, the Automatic System & Flow MAP Detector 30*f*, the Automatic Control Design/Setup Module 30*g*, the Automatic Pump/Motor/Drive Detector 30*h*, and a pump/motor/drives database or ICLOUD® 30*i*, e.g., consistent with that shown in FIG. 3.

Here, the Pump/Motor/Drive Detector 30*h* may be used for pumps, motors and drives selection and configuration automatically, based upon their signature chip or barcode installed. The Auto System & Flow MAP Detector 30*f* may be used for obtaining moving average peak (MAP) of an unknown system as well as the flow rate in system. The Auto Control Design/Setup Module 30*g* may be used to configure the adaptive control curve and real time graphic pump characteristics curves and operation parameters accordingly and automatically. The Auto Self-driving Module 30*e* may be used to derive the adaptive pressure set point, the instant pump speed by a PID control with respect to the adaptive pressure set point derived and the instant pressure value from a pressure transducer or a sensorless converter, and to run ASD-pump at the speed, accordingly.

The data transmitter 30*d* attached to an ASD-pump like element 30*a* is used for transmitting and receiving the sensors and drive signals from the pumping control.

Consistent with that set forth above, the ASD-pump prototype shown in FIG. 4 is an integrated pump and pumping control system which can be designed, set up and run automatically on any unknown hydronic systems, with pump/motor/drive parameters and data in the control configurable automatically from the database based upon their signature chip. In the present invention in FIG. 4, the Auto System & Flow MAP Detector 30*f*, Auto Control Design/Setup Module 30*g* and Auto Self-driving Module 30*e* are the core components for the ASD-pump to run in terms of automatic and self-driving key features, while the Pump/Motor/Drive Detector 30*h*, the Data transmitter 30*d* and Sensors converter 30*d* are fundamental function modules to make those features feasible as well.

An energy saving module regarding outdoor temperature variation as well as day and night temperature scheduling functional module may be integrated into the pump control design toolbox in the ASD-pumps control to save pumping operation energy in the consideration with those environmental circumstances as well.

With a hydronic system recognition module and a moving flow peak detector integrated with system and flow adaptive control, an automatic pump control design, setup and run functionalities may be realized by deriving the desired pump design point as well as pressure set point automatically. For that, with one push button of "Auto Cntl" in the pump design toolbox, the pump control can be designed, setup and run automatically for a known or unknown hydronic system with the minimized pumping energy consumption.

Flow and pressure signals for the pumping control for ASD-pumps may be provided by a sensorless converter or by sensors as well, to obtain the real time pump, system and control characteristics curves accordingly.

Lastly, the graphic touch screen display (e.g., 20*c* (FIG. 2B) in the pump control design toolbox for ASD-pumps will be one of the best candidates recommended for deriving the design point and for displaying the curves and operation data as well. Some low cost PLDs or even PC boards may, however, be feasible for a pump control design toolbox as well for ASD-pumps.

In summary, according to some embodiments of the present invention an ASD-pump can be designed, set up and run automatically with any kinds of drives, high-end or low end, and so forth, and run on any unknown static or variable systems. ASD-pump's pumping controls software can be configured in a remote computer through a communication protocol optimally, or a locally attached PID pumping controller. All the information of power consumption, flow rate and pressure for the control and monitoring signals needed are obtained with a sensorless converter or with sensors. A data transmitter is used to convert and/or transmit all sensors signals from pumps and drives to the pump controller through the communication protocols. The transmitter may be integrated with the pump directly or is embedded as a coprocessor in a drive as well.

SUMMARY OF EMBODIMENTS/IMPLEMENTATIONS

According to some embodiments, the present invention may include, or take the form of, implementations where the ASD-pump technique includes primarily a pump integrated with a remote or locally attached pumping control which has automatic pump control design, setup and self-driving capabilities for any unknown hydronic system, a drive, sensors or a sensorless converter, and a data transmitter. An automatic self-driving pump (ASD-pump) is an integrated pumping control system, which is designed, setup and run automatically on an unknown hydronic systems with energy saving, sensorless as well as some other advanced features as shown in FIG. 2. The ASD-pump consists of a pump integrated with a pumping control of (a) remotely in a computer or (b) locally attached, a data transmitter for converting sensors signals to pumping control through a communication protocol, and a VFD drive, respectively.

According to some embodiments, the present invention may include, or take the form of, implementations where the pump control in ASD-pumps technique includes the Automatic Pump/Motor/Drive Detector 30*h*, Automatic System & Flow MAP Detector 30*f*, Automatic Control Design/Setup Module 30*g*, the Automatic Self-driving Module 30*e*, Data Transmitter 30*d*, Sensors converter 30*c*, the pump/motor/drives database or iCloud 30*i*, and a drive firmware module, as shown and described in relation to FIGS. 2 and 3.

According to some embodiments, the present invention may include, or take the form of, implementations where the pump control in ASD-pumps technique includes the Automatic Pump/Motor/Drive Detector 30*h*, Automatic System & Flow MAP Detector 30*f*, Automatic Control Design/Setup Module 30*g*, the Automatic Self-driving Module 30*e*, Data Transmitter 30*d*, Sensors converter 30*c*, the pump/motor/drives database or iCloud 30*i*®, and a drive firmware module, as shown and described in relation to FIGS. 2 and 3.

According to some embodiments, the present invention may include, or take the form of, implementations where the Pump/Motor/Drive Detector 30*h* includes a search algorithms for pumps, motors and drives selection and configuration automatically, based upon their signature chip or barcode installed which can be scanned into pump control system automatically by a scanner once installed. Their parameters including power, voltage, phase, RPM, impeller size, pump curves data, and so on, can be searched and configured automatically from the pump/motor/drive database or ICLOUD® 30*i* by the Pump/Motor/Drive detector 30*h*, based upon their signatures.

According to some embodiments, the present invention may include, or take the form of, implementations where the Auto System & Flow MAP Detector 30*f* in pump control in ASD-pumps technique includes a control module for obtaining moving average peak (MAP) of an unknown system as well as the flow rate in system defined in Eq. (1). The Auto System & Flow MAP Detector 30*f* may be applicable not only for a static hydronic system, but also a variable system as well. Since it is a moving average peak detector up on system coefficient and flow rate, the $\overline{C}_{vmax}$ and $\overline{Q}_{max}$ obtained through MAP from Eq. (1) are adaptive to system and flow rate changes depending upon the sampling time and filter length in moving average digital filters. All those parameters are derived or set up automatically after ASD-pump is started initially.

According to some embodiments, the present invention may include, or take the form of, implementations where the Auto Control Design/Setup Module 30*g* in pump control in ASD-pumps technique includes a control module which is used for deriving an adaptive pressure set point in Eq. (2). All other parameters in Eq. (2) are set up automatically after ASD-pump is started.

According to some embodiments, the present invention may include, or take the form of, implementations where the Auto Self-driving Module 30*e* in pump control in ASD-pumps technique includes a control module which is to derive the pump speed of n by a PID pump control with respect to the adaptive pressure set point of SP and the instant pressure value from a pressure transducer or a sensorless converter.

According to some embodiments, the present invention may include, or take the form of, implementations where the data transmitter includes the data transmitter 30*d* used mainly for transmitting the sensors and drive signals for a pumping control through a communication protocol. Here, the sensors signals transmitted by the data transmitter 30*d* may include control signals, such as flow, pressure, temperature, and so on, and condition monitoring signals, such as vibration, power, or thermal as well. The drive signals may include all those digital and analog input/output (IO)

signals for drive/pump control. All those signals mentioned above can be transmitted to pump control directly without routing through the data transmitter 30*d*, if the drive may provide sufficient analog input terminals.

According to some embodiments, the present invention may include, or take the form of, implementations where the sensor(s) converter includes a sensors converter 30*c* used to convert sensorless signals of system pressure and flow rate. For the sensorless control, the power or one of its equivalent signal such as current or torque may be converted as well.

According to some embodiments, the present invention may include, or take the form of, implementations where the Pump/motor/drives database includes a database or ICLOUD 30*i* which contains all the pumps, motors and drives data including power, voltage, phase, RPM, impeller size, pump curves, power curves, and so on, which can be searched through and configured automatically by the Pump/Motor/Drive Detector 30*h*.

According to some embodiments, the present invention may include, or take the form of, implementations where the ASD-pumps technique include an energy saving module for outdoor temperature variation as well as day and night temperature scheduling functional module, which may be integrated into the pump control design toolbox in the ASD-pumps control to save pumping operation energy with the consideration of environmental circumstances as well.

According to some embodiments, the present invention may include, or take the form of, implementations where the flow and pressure signals for the energy saving control for ASD-pumps technique are provided by either a sensorless converter, or by sensors as well, in order to obtain the real time pump, system and control characteristics curves displayed in screen.

According to some embodiments, the present invention may include, or take the form of, implementations where the ASD-pumps technique includes the graphic touch screen display in the pump control design toolbox for selecting automatically the design point and for displaying the curves and operation data as well. Some low cost PLDs or even pc boards may, however, be feasible as well for a pump control design toolbox for ASD-pumps.

According to some embodiments, the present invention may include, or take the form of, implementations where the pumping hydronic system includes all close loop or open loop hydronic pumping systems, such as primary pumping systems, secondary pumping systems, water circulating systems, and pressure booster systems. The systems mentioned here may consist of a single zone or multiple zones as well.

According to some embodiments, the present invention may include, or take the form of, implementations where the hydronic signals derived by sensors or a sensorless converter include pump differential pressure, system pressure or zone pressure, system or zone flow rates, and so forth.

According to some embodiments, the present invention may include, or take the form of, implementations where the control signals transmitting and wiring technologies mentioned here include all conventional sensing and transmitting techniques that are used currently. Preferably, wireless sensor signal transmission technologies would be optimal and favorable.

According to some embodiments, the present invention may include, or take the form of, implementations where the pumps for the hydronic pumping systems includes a single pump, a circulator, a group of parallel ganged pumps or circulators, a group of serial ganged pumps or circulators, or their combinations.

THE FAMILY OF RELATED TECHNOLOGIES

This disclosure is related to a family of disclosures, e.g., including:

Reference [1]: [911-019-001-2 (F-B&G-1001)] by Andrew Cheng and James Gu, entitled "Method and Apparatus for Pump Control Using Varying Equivalent System Characteristic Curve, a/k/a an Adaptive Control Curve," having application Ser. No. 12/982,286, and issuing as U.S. Pat. No. 8,700,221.

Reference [2]: [911-019-004-3 (F-B&G-X0001] by Andrew Cheng, James Gu and Graham Scott, entitled "Dynamic Linear Control Methods And Apparatus For Variable Speed Pump Control," having patent application Ser. No. 13/717,086, filed 17 Dec. 2012, claiming benefit to provisional application No. 61/576,737, filed on Dec. 16, 2011.

Reference [3]: [911-019-009-2 (F-B&G-X0005)] by Andrew Cheng, James Gu, Graham Scott, entitled "3D Sensorless Conversion Means and Apparatus for Pumping System Pressure and Flow," having patent application Ser. No. 14/091,795, filed on 27 Nov. 2013, claiming benefit to provisional patent application No. 61/771,375, filed 1 Mar. 2013.

Reference [4]: [911-019-010-3 (F-B&G-X0008)] by Andrew Cheng, James Gu and Graham Scott, entitled "A Mixed Theoretical and Discrete Sensorless Converter for Pump Differential Pressure and Flow Monitoring," having application Ser. No. 14/187,817, claiming benefit to provisional patent application No. 61/803,258, filed 19 Mar. 2013.

Reference [5]: [911-019-012-2 (F-B&G-X0010)] by Andrew Cheng, James Gu and Graham Scott, entitled "Sensorless Adaptive Pump Control with Self-Calibration Apparatus for Hydronic Pumping Systems" having application Ser. No. 14/339,594, filed 24 Jul. 2014, claiming benefit to the provisional application No. 61/858,237, filed on Jul. 25, 2013.

Reference [6]: [911-019-014-2 (F-B&G-X0012)] by Andrew Cheng, James Gu and Graham Scott, entitled "Best-Fit Affinity Sensorless Conversion Means Or Technique For Pump Differential Pressure And Flow Monitoring," having application Ser. No. 14/680,667, filed on 7 Apr. 2015, claiming benefit to the provisional application No. 61/976,749, filed on Apr. 8, 2014.

Reference [7]: [911-019.015-3 (F-B&G-X0013)] by Andrew Cheng, James Gu and Graham Scott, entitled "System and Flow Adaptive Pumping Control Apparatus—A Minimum Pumping Energy Operation Control System vs. Sensorless Application," having application Ser. No. 14/730,871; claiming benefit to provisional application No. 62/007,474, filed 4 Jun. 2014.

Reference [8]: [911-019-017-3 (F-B&G-X0015] by Andrew Cheng and James Gu, entitled "A Discrete Valves Flow Rate Converter Device," having application Ser. No. 14/969,723, filed 15 Dec. 2015, claiming benefit to provisional application No. 62/091,965, filed on 15 Dec. 2014.

Reference [9]: [911-019-019-1 (F-B&G-X0016)] by Andrew Cheng and James Gu, entitled "No Flow Detection Means for Sensorless Pumping Control Applications," having application Ser. No. 15/044,670, filed 16 Feb. 2016, claiming benefit to Provisional Application No. 62/116,031, filed on 13 Feb. 2015.

Reference [10]: [911-019-020-1 (F-B&G-X0020] by Andrew Cheng, James Gu and Kyle Schoenheit, entitled "Direct numerical Sensorless conversion apparatus for pumping control," having application Ser. No. 15/173,781, filed 6 Jun. 2016, claiming benefit to provisional application No. 62/170,977, filed 4 Jun. 2015.

Reference [11]: [911-019-022-1 (F-B&G-X0022] by Andrew Cheng, James Gu and Kyle Schoenheit, entitled "Advanced Real Time Graphic Sensorless Energy Saving Pump Control System," having Ser. No. 15/217,070, filed 22 Jul. 2016, claiming benefit to provisional application No. 62/196,355, filed on 24 Jul. 2015; which are all hereby incorporated by reference in their entirety.

FIG. 5: Implementation of Signal Processing Functionality

By way of further example, FIG. 6 shows a control or controller 40 for a module or device 10*b*, 20*b* 30*c*, 30*d*, 30*e*, 30*f*, 30*g*, 30*h* or 30*i* in FIGS. 2 and 3 that forms part of the automatic self-driving pump system. The control or controller 40*a* includes a signal processor or processing module configured at least to:

receive signaling containing information for performing or implementing signal processing functionality associated with at least one of the modules or devices 10*b*, 20*b*, 30*c*, 30*d*, 30*e*, 30*f*, 30*g*, 30*h* or 30*i* in FIGS. 2 and 3;

determine corresponding signaling containing information for providing from the modules or devices 10*b*, 20*b*, 30*c*, 30*d*, 30*e*, 30*f*, 30*g*, 30*h* or 30*i* in FIGS. 2 and 3 in order to implement the signal processing functionality, based upon the signaling received; and/or provide the corresponding signaling as control and/or signaling from the modules or devices 10*b*, 20*b*, 30*c*, 30*d*, 30*e*, 30*f*, 30*g*, 30*h* or 30*i* in FIGS. 2 and 3 to implement the signal processing functionality in the automatic self-driving pump system.

In operation, the signal processor or processing module 40*a* may be configured to provide the corresponding signaling as the control signaling to control a pump or a system of pumps, e.g., as design signaling to configure or design the pump or a system of pumps, e.g., such as a system of pumps in a hydronic pumping system. By way of example, the corresponding signaling may also be used to control the pumping hydronic system.

By way of example, the functionality of the signal processor or processing module 40*a* may be implemented using hardware, software, firmware, or a combination thereof. In a typical software implementation, the signal processor or processing module 40*a* would include one or more microprocessor-based architectures having, e. g., at least one signal processor or microprocessor like element. One skilled in the art would be able to program with suitable program code such a microcontroller-based, or microprocessor-based, implementation to perform the functionality described herein without undue experimentation. For example, the signal processor or processing module may be configured, e.g., by one skilled in the art without undue experimentation, to receive the signaling, consistent with that disclosed herein. Moreover, the signal processor or processing module may be configured, e.g., by one skilled in the art without undue experimentation, to determine the corresponding signaling, consistent with that disclosed herein.

The scope of the invention is not intended to be limited to any particular implementation using technology either now known or later developed in the future. The scope of the invention is intended to include implementing the functionality of the processors as stand-alone processor, signal processor, or signal processor module, as well as separate processor or processor modules, as well as some combination thereof.

The signal processor or processing module 40*a* may also include, e.g., other signal processor circuits or components 40*b*, including random access memory or memory module (RAM) and/or read only memory (ROM), input/output devices and control, and data and address buses connecting the same, and/or at least one input processor and at least one output processor, e.g., which would be appreciate by one skilled in the art. By way of example, the signal processor or processing module 40*a*, 40*b* may include, or take the form of, at least one signal processor and at least one memory including computer program code, and the at least one memory and computer program code are configured to, with at least one signal processor, to cause the signal processor at least to receive the signaling and determine the corresponding signaling, and the signaling received. The signal processor or processing module may be configured with suitable computer program code in order to implement suitable signal processing algorithms and/or functionality, consistent with that set forth herein. One skilled in the art would appreciate and understand how to implement any such computer program code to perform the signal processing functionality set forth herein without undue experimentation based upon that disclosed in the instant patent application.

Computer Program Product

The present invention may also, e. g., take the form of a computer program product having a computer readable medium with a computer executable code embedded therein for implementing the method, e.g., when run on a signal processing device that forms part of such a pump or valve controller. By way of example, the computer program product may, e. g., take the form of a CD, a floppy disk, a memory stick, a memory card, as well as other types or kind of memory devices that may store such a computer executable code on such a computer readable medium either now known or later developed in the future.

OTHER RELATED APPLICATIONS

The application is related to other patent applications that form part of the overall family of technologies developed by one or more of the inventors herein, and disclosed in the following applications:

U.S. application Ser. No. 12/982,286, filed 30 Dec. 2010, entitled "Method and apparatus for pump control using varying equivalent system characteristic curve, AKA an adaptive control curve," which issued as U.S. Pat. No. 8,700,221 on 15 Apr. 2014; and U.S. application Ser. No. 13/717,086, filed 17 Dec. 2012, entitled "Dynamic linear control methods and apparatus for variable speed pump control," which claims benefit to U.S. provisional application No. 61/576,737, filed 16 Dec. 2011, now abandoned;

U.S. application Ser. No. 14/680,667, filed 7 Apr. 2015, entitled "A Best-fit affinity sensorless conversion means for pump differential pressure and flow monitoring," which claims benefit to provisional patent application Ser. No. 61/976,749, filed 8 Apr. 2014, now abandoned;

U.S. application Ser. No. 14/730,871, filed 4 Jun. 2015, entitled "System and flow adaptive sensorless pumping control apparatus energy saving pumping applications," which claims benefit to provisional patent application Ser. No. 62/007,474, filed 4 Jun. 2014, now abandoned; and U.S. application Ser. No. 14/969,723, filed 15 Dec. 2015, entitled "Discrete valves flow rate converter," which claims benefit to U.S. provisional application No. 62/091,965, filed 15 Dec. 2014;

U.S. application Ser. No. 15/044,670, filed 16 Feb. 2016, entitled "Detection means for sensorless pumping control applications," which claims benefit to U.S. provisional application No. 62/116,031, filed 13 Feb. 2015, entitled "No flow detection means for sensorless pumping control applications;"

which are all assigned to the assignee of the instant patent application, and which are all incorporated by reference in their entirety herein.

THE SCOPE OF THE INVENTION

It should be understood that, unless stated otherwise herein, any of the features, characteristics, alternatives or modifications described regarding a particular embodiment herein may also be applied, used, or incorporated with any other embodiment described herein. Also, the drawing herein is not drawn to scale.

Although the present invention is described by way of example in relation to a centrifugal pump, the scope of the invention is intended to include using the same in relation to other types or kinds of pumps either now known or later developed in the future.

Although the invention has been described and illustrated with respect to exemplary embodiments thereof, the foregoing and various other additions and omissions may be made therein and thereto without departing from the spirit and scope of the present invention.

What we claim is:

1. An automatic self-driving pump system, comprising:

a controller having a signal processor configured to receive sensed signaling containing information about parameters for automatic pump control design, initial setup and run to control a pump drive for operating in a hydronic pump system, and provide control signaling containing information to control the pump drive for an initial startup configuration and subsequent operation in the hydronic pump system after the initial startup, based upon the sensed signaling received;

the controller comprising:

an automatic self-driving module configured to receive the control signaling and pressure and flow signaling containing information about the pressure (P) and flow (Q) of the pump drive, and provide automatic self-driving module signaling containing information to control the pump drive for the initial startup configuration and subsequent operation in the hydronic pump system after initial startup; and an automatic system and flow moving average peak (MAP) detector configured to receive the pressure and flow signaling, and provide automatic system and flow MAP detector signaling based upon a moving average peak (MAP) determined;

the MAP being determined and defined as following:

$$\overline{C}_{vmax}(t) = \begin{cases} MAP(C_v(t)), & C_v < \overline{C}_{vmax} \\ C_v(t), & C_v \geq \overline{C}_{vmax} \end{cases} \quad (1.1)$$

$$\overline{Q}_{max}(t) = \begin{cases} MAP(Q(t)), & Q < \overline{Q}_{max} \\ Q(t), & Q \geq \overline{Q}_{max} \end{cases}, \quad (1.2)$$

where the MAP function is a moving average peak detector, $C_v$ is a system dynamic friction coefficient derived by a system flow equation of $C_v = Q/\sqrt{\Delta P}$, where $\Delta P$ is differential pressure of pump, $\overline{C}_{vmax}$ represents the MAP of $C_v$.

2. The automatic self-driving pump system according to claim 1, wherein the sensed signaling received includes signature chip or barcode signaling containing information about the pump drive for operating in the hydronic pump system.

3. The automatic self-driving pump system according to claim 2, wherein the controller comprises a pump motor drive detector configured to receive the signature chip or barcode signaling, and provide pump motor drive detector signaling containing information about the parameters, based upon the signature chip or barcode signaling received.

4. The automatic self-driving pump system according to claim 1, wherein the parameters include some combination of power, voltage, phase, RPM, impeller size, and pump curve data.

5. The automatic self-driving pump system according to claim 3, wherein the pump motor drive detector is configured to search a database for the parameters, based upon the signature chip or barcode signaling received.

6. The automatic self-driving pump system according to claim 5, wherein the database is a pump motor drive database or a cloud-based database.

7. The automatic self-driving pump system according to claim 1, wherein the automatic self-driving module signaling includes information about the speed (n) of the pump drive.

8. The automatic self-driving pump system according to claim 1, wherein the automatic self-driving pump system comprises a data transmitter configured to receive the automatic self-driving signaling and transmit the automatic self-driving signaling to the pump drive, and receive the pressure and flow signaling, and provide the pressure and flow signaling to the automatic self-driving module.

9. The automatic self-driving pump system according to claim 1, wherein the controller comprises an automatic control design setup module configured to receive the automatic system and flow MAP detector signaling, and provide the control signaling, based upon the automatic system and flow MAP detector signaling received.

10. An automatic self-driving pump system comprising:

a controller having a signal processor configured to receive sensed signaling containing information about parameters for automatic pump control design, initial setup and run to control a pump drive for operating in a hydronic pump system, and provide control signaling containing information to control the pump drive for an initial startup configuration and subsequent operation in the hydronic pump system after the initial startup, based upon the sensed signaling received;

the controller comprising:

an automatic self-driving module configured to receive the control signaling and pressure and flow signaling containing information about the pressure (P) and flow (Q) of the pump drive, and provide automatic self-driving module signaling containing information to control the pump drive for the initial startup configuration and subsequent operation in the hydronic pump system after initial startup;

an automatic system and flow moving average peak (MAP) detector configured to receive the pressure and flow signaling, and provide automatic system and flow MAP detector signaling based upon a moving average peak (MAP) determined; and an automatic control design setup module configured to receive the automatic system and flow MAP detector signaling, and provide the control signaling, based upon the automatic system and flow MAP detector signaling received;

the MAP being determined and defined as following:

$$\overline{C}_{vmax}(t) = \begin{cases} MAP(C_v(t)), & C_v < \overline{C}_{vmax} \\ C_v(t), & C_v \geq \overline{C}_{vmax} \end{cases} \quad (1.1)$$

$$\overline{Q}_{max}(t) = \begin{cases} MAP(Q(t)), & Q < \overline{Q}_{max} \\ Q(t), & Q \geq \overline{Q}_{max} \end{cases}, \quad (1.2)$$

where the MAP is a moving average peak detector, $C_v$ is a system dynamic friction coefficient derived by a system flow equation of $C_v = Q/\sqrt{\Delta P}$, where $\Delta P$ is differential pressure of pump, $\overline{C}_{vmax}$ represents the MAP of $C_v$.

11. The automatic self-driving pump system according to claim 10, wherein the controller is configured to derive or setup the parameters automatically after the pump drive is started initially.

12. The automatic self-driving pump system according to claim 10, wherein the automatic control design setup module is configured to determine an adaptive control curve and real time graphic pump characteristics curves and operation parameters automatically.

13. The automatic self-driving pump system according to claim 12, wherein the automatic control design setup module is configured to determine the adaptive control curve for deriving an adaptive pressure set point of based upon following equation (2):

$$SP(t) = \left(\frac{Q(t)}{\overline{Q}_{max}(t)}\right)^{\alpha} \left((\overline{Q}_{max}(t)/\overline{C}_{vmax}(t))^2 - b_0\right) + b_0 \quad (2)$$

where $b_0$ is the minimum pressure at no flow, $\alpha$ is a control curve setting parameter varying as $1 \leq \alpha \leq 2$ defined in between a linear curve and a quadratic one.

14. The automatic self-driving pump system according to claim 13, wherein the controller is configured to setup automatically all associated parameters in Eq. 2 after the pump drive is started initially.

15. The automatic self-driving pump system according to claim 2, wherein the signature chip or barcode signaling is stored in and sensed from a signature chip or barcode installed that can be scanned into the pump controller automatically, including by a scanner.

16. The automatic self-driving pump system according to claim 1, wherein the automatic self-driving pump system comprises the pump drive configured to receive the control signaling and operate in the hydronic pump system.

17. A method for automatic self-driving pump system, comprising:

receiving, in a controller having a signal processor, sensed signaling containing information about parameters for automatic pump control design, initial setup and run to control a pump drive for operating in a hydronic pump system, and providing, from the controller, control signaling containing information to control the pump drive for an initial startup configuration and subsequent operation in the hydronic pump system after the initial startup, based upon the signaling received; and configuring the controller with an automatic self-driving module that receives the control signaling and pressure and flow signaling containing information about the pressure (P) and flow (Q) of the pump drive, and provides automatic self-driving module signaling containing information to control the pump drive for the initial startup configuration and subsequent operation in the hydronic pump system after initial startup, and an automatic system and flow moving average peak (MAP) detector that receives the pressure and flow signaling, and provides automatic system and flow MAP detector signaling based upon a moving average peak (MAP) determined; and the MAP being determined and defined as following:

$$\overline{C}_{vmax}(t) = \begin{cases} MAP(C_v(t)), & C_v < \overline{C}_{vmax} \\ C_v(t), & C_v \geq \overline{C}_{vmax} \end{cases} \quad (1.1)$$

$$\overline{Q}_{max}(t) = \begin{cases} MAP(Q(t)), & Q < \overline{Q}_{max} \\ Q(t), & Q \geq \overline{Q}_{max} \end{cases} \quad (1.2)$$

where the MAP function is a moving average peak detector, $C_v$ is a system dynamic friction coefficient derived by a system flow equation of $C_v = Q/\sqrt{\Delta P}$, where $\Delta P$ is differential pressure of pump, $\overline{C}_{vmax}$ represents the MAP of $C_v$.

18. The method according to claim 17, wherein the sensed signaling received includes signature chip or barcode signaling containing information about the pump drive for operating in the hydronic pump system.

19. The method according to claim 17, wherein the parameters include some combination of power, voltage, phase, RPM, impeller size, and pump curve data.

20. The method according to claim 17, wherein the method comprises configuring the controller with an automatic control design setup module that receives the automatic system and flow MAP detector signaling, and provides the control signaling, based upon the automatic system and flow MAP detector signaling received.

21. An method for automatic self-driving pump system, comprising:

receiving, in a controller having a signal processor, sensed signaling containing information about parameters for automatic pump control design, initial setup and run to control a pump drive for operating in a hydronic pump system, and providing, from the controller, control signaling containing information to control the pump drive for an initial startup configuration and subsequent operation in the hydronic pump system after the initial startup, based upon the signaling received; and configuring the controller with an automatic self-driving module that receives the control signaling and pressure and flow signaling containing information about the pressure (P) and flow (Q) of the pump drive, and provides automatic self-driving module signaling containing information to control the pump drive for the initial startup configuration and subsequent operation in the hydronic pump system after initial startup, an automatic system and flow moving average peak (MAP) detector that receives the pressure and flow signaling, and provides automatic system and flow MAP detector signaling based upon a moving average peak (MAP) determined, and an automatic control design setup module that receives the automatic system and flow MAP detector signaling, and provides the control signaling, based upon the automatic system and flow MAP detector signaling received;

the MAP being determined and defined as following:

$$\overline{C}_{vmax}(t) = \begin{cases} MAP(C_v(t)), & C_v < \overline{C}_{vmax} \\ C_v(t), & C_v \geq \overline{C}_{vmax} \end{cases}, \tag{1.1}$$

$$\overline{Q}_{max}(t) = \begin{cases} MAP(Q(t)), & Q < \overline{Q}_{max} \\ Q(t), & Q \geq \overline{Q}_{max} \end{cases}, \tag{1.2}$$

where the MAP is a moving average peak detector, $C_v$ is a system dynamic friction coefficient derived by a system flow equation of $C_v = Q/\sqrt{\Delta P}$, where $\Delta P$ is differential pressure of pump, $\overline{C}_{vmax}$ represents the MAP of $C_v$.

22. The method according to claim 21, wherein the sensed signaling received includes signature chip or barcode signaling containing information about the pump drive for operating in the hydronic pump system.

23. The method according to claim 21, wherein the parameters include some combination of power, voltage, phase, RPM, impeller size, and pump curve data.

* * * * *